US005408302A

United States Patent [19]

Manzer et al.

[11] Patent Number: 5,408,302

[45] Date of Patent: Apr. 18, 1995

[54] PRINTING OR COPYING MACHINE WITH A BELT-TYPE TRANSFER ELEMENT WITH ASSOCIATED ELECTROSTATIC DEVICE FOR TRANSFERRING TONER IMAGES FROM AN INTERMEDIATE IMAGE-CARRIER

[75] Inventors: Hans Manzer, Seefeld; Peter Bergmann, Oberding; Albrecht Gerstner, Mühldorf/Inn; Otto Ferber, Munich; Peter König, Starnberg, all of Germany

[73] Assignee: Siemens Nixdorf Informationssysteme Aktiengesellschaft, Paderborn, Germany

[21] Appl. No.: 94,105

[22] PCT Filed: Feb. 3, 1992

[86] PCT No.: PCT/EP92/00224

§ 371 Date: Aug. 3, 1993

§ 102(e) Date: Aug. 3, 1993

[87] PCT Pub. No.: WO92/14192

PCT Pub. Date: Aug. 20, 1992

[30] Foreign Application Priority Data

Feb. 5, 1991 [DE] Germany ..... 91101539

[51] Int. Cl.[6] ..... G03G 15/14; G03G 15/20

[52] U.S. Cl. ..... 355/285; 219/216; 355/271; 355/279; 355/282; 355/285; 355/319; 355/23; 430/126

[58] Field of Search ..... 355/271, 272, 273, 274, 355/277, 282, 285, 289, 290, 295, 318, 319, 23, 24, 279; 271/184–186, 225, 226, 902; 219/216; 430/126

[56] References Cited

U.S. PATENT DOCUMENTS

| | | | |
|---|---|---|---|
| 2,885,955 | 5/1959 | Vyverberg | 355/277 |
| 2,990,278 | 6/1961 | Carlson . | |
| 3,548,783 | 12/1970 | Knapp | 355/318 X |
| 3,790,273 | 2/1974 | Tanaka . | |
| 3,893,761 | 7/1975 | Buchan et al. | 355/272 |
| 3,923,392 | 12/1975 | Buchan et al. | 355/271 |
| 3,947,113 | 3/1976 | Buchan et al. | 355/271 |
| 4,232,961 | 11/1980 | Masuda | 355/271 |
| 4,453,820 | 6/1984 | Suzuki | 219/216 X |
| 4,455,079 | 6/1984 | Miwa et al. | 355/295 X |
| 4,477,176 | 10/1984 | Russel | 271/186 X |
| 4,526,459 | 7/1985 | Bresnick | 219/216 X |
| 4,537,493 | 8/1985 | Russel . | |
| 4,708,460 | 11/1987 | Langdon | 355/271 |
| 4,755,849 | 7/1988 | Tarumi et al. | 219/216 X |
| 4,796,048 | 1/1989 | Bean | 355/277 |
| 4,796,066 | 1/1989 | Morris et al. | 355/26 |
| 4,912,514 | 3/1990 | Mizutani | 355/272 |
| 4,931,839 | 6/1990 | Tompkins et al. | 355/277 |
| 4,935,787 | 6/1990 | Maeda et al. | 355/326 |
| 4,980,729 | 12/1990 | Okamoto | 355/320 |
| 4,992,833 | 2/1991 | Derimiggio | 355/282 |
| 5,117,261 | 5/1992 | Sakai et al. | 355/272 X |
| 5,208,638 | 5/1993 | Bujese et al. | 355/274 |
| 5,233,397 | 8/1993 | Till | 355/279 |

FOREIGN PATENT DOCUMENTS

| | | |
|---|---|---|
| 0254572 | 1/1988 | European Pat. Off. . |
| 0297721 | 1/1989 | European Pat. Off. . |
| 63-263877 | 10/1988 | Japan . |
| 2040226 | 8/1980 | United Kingdom . |

*Primary Examiner*—Matthew S. Smith
*Attorney, Agent, or Firm*—Hill, Steadman & Simpson

[57] ABSTRACT

A printing or copying machine has a photoconductor (10) with associated recording and developing station (EY, EM, EC, EB) for producing single-color or multi-color toner images on the intermediate image-carrier (10). The toner images are transferred electrostatically, in a transfer zone (T) onto a belt-type transfer element (16) and then, in transfer and fusing zones (U1, U2), printed from the underneath from the transfer element onto the recording carriers (24). In order to facilitate the fusing of the transfer image in the transfer and fusing stations (U1, U2), heating units (23, 31) for heating the toner images on the transfer element (16) and/or for heating the recording carrier (24) are provided. Between the first and the second transfer and fusing station (U1, U2), a turning station (W) is arranged. The printing or copying machine can be operated in the simplex and duplex printing mode of operation to produce single-color or multi-color copies.

16 Claims, 2 Drawing Sheets

PRINTING OR COPYING MACHINE WITH A BELT-TYPE TRANSFER ELEMENT WITH ASSOCIATED ELECTROSTATIC DEVICE FOR TRANSFERRING TONER IMAGES FROM AN INTERMEDIATE IMAGE-CARRIER

A printing or copying machine with a belt-type transfer element with associated electrostatic device for transferring toner images from an intermediate image-carrier.

BACKGROUND OF THE INVENTION

The invention relates to a printing or copying machine for single-color or multi-color simplex or duplex printing using a belt-type transfer element and a method for printing on recording media using a printing or copying machine of this type.

Printing or copying machines of the aforesaid type are disclosed, for example, in U.S. Pat. Nos. 4,477,176 and 4,537,493. These machines are electrophotographic devices with a photoconductor on which at least two charge images can be arranged one behind the other, the machines having a print-transfer station with associated single-sheet positioning device (turning device) which permits the electrophotographic printing device to be operated in two modes of operation, specifically in a first mode of operation in which the inked-in toner images which are arranged one behind the other on the charge image carrier are arranged one above the other or one next to the other on one side of the single sheet, and in a second mode of operation in which the sequence of toner images located on the charge image carrier is arranged on the front side and rear side of the single sheet. The fusing of the toner images on the single sheets is effected with the aid of a roller fusing station using pressure and very high temperatures.

In the duplex printing mode of operation in which a toner image is arranged on each side of the single sheet, the fusing of the front and rear side takes place simultaneously. For this purpose, the single sheet which is printed on on one side must be turned and printed on again on the other side, and subsequently it is conveyed in a contactless fashion to the roller fusing station, for example by means of an air cushion.

This requires a very high mechanical outlay if a high operational reliability is to be ensured for a wide range of printing materials.

Furthermore, U.S. Pat. No. 2,990,278 and Great Britain Patent 2,040,226 (corresponding to U.S. Pat. No. 4,453,820) disclose electrophotographic printing devices with which character-dependent charge images are produced on a photoconductor with the aid of an exposure device and are fed to a developing station. The developed charge image is then lifted off from the photoconductor mechanically by pressure with the aid of a belt-type transfer element and transferred to a recording carrier. In order to be able to fuse the toner image on the recording carrier, the toner image on the belt-type transfer element is heated with the aid of a heating device and the heated toner image is applied to the recording carrier by means of a roller arrangement using pressure and heat. After the transfer of the toner image to the recording carrier, the toner which is adhering is cleaned from the intermediate image-carrier in a cleaning station.

The transfer of the image information from the photoconductor to the belt-type transfer element is effected purely mechanically by contact pressure and rolling. The transfer element is relatively good at seizing individual toner particles mechanically. Print images which consist of a plurality of layers of toner are, however, only transferred inadequately or with a very poor transfer efficiency.

The result of this is that, when the belt-type transfer element is used in this way, firstly virtually no background particles can be developed on the photoconductor and, secondly, development toner technologies which result in a single-layer print information development have to be used.

The technology necessary for this (conductive single-component magnetic toner, highly sensitive photoconductor, very high exposure powers), is not appropriate for high-performance printers for reasons of economy and due to the technical complexity.

The conventional proven technology of high-performance printers operating according to the electrophotographic principle consists in the so-called two-component development method, a method in which a mixture of ferromagnetic carrier particles and toner particles is used as the developer mixture. This development method, referred to as dry inking, is cost-effective and is used in general in conjunction with arsenic triselenide photoconductor drums or OPC photoconductor belts. However, since this technology results both in a clear background inking and also in a plurality of layers of toner in the developed print image, the purely mechanical transfer onto a belt-type transfer element with very high print quality requirements is not possible.

SUMMARY OF THE INVENTION

The object of the invention is therefore to provide a printing machine or copying machine with a belt-type transfer element and an associated printing method which permits the use of conventional known development methods in which in the developed print image the toner can be arranged in a plurality of layers.

A further objective of the invention is to provide a printing machine or copying machine with a belt-type transfer element which is of simple and operationally reliable construction, guarantees a high printing quality and permits simplex printing and duplex printing.

In general terms the present invention is an electrophotographic printing machine having an intermediate image-carrier with associated recording and developing station. It produces toner images, of multi-layer construction, on the intermediate image-carrier by dry inking of the intermediate image-carrier in the developing station with a two-component developer mixture. The printing machine has a belt-type transfer element with associated transfer zone for transferring toner images from the intermediate image-carrier. An electrostatic transfer means is assigned to the transfer zone. A first combined transfer and fusing zone transfers the toner images from the transfer element onto a recording carrier with simultaneous fusing of the toner images on the recording carrier by mechanical rolling of the transfer element on the recording carrier. A transport channel transports the recording carrier from a supply zone to the first transfer and fusing zone. A heating means heats the toner images on the transfer element and/or heats the recording carrier.

Further advantageous developments of the present invention are as follows.

The electrostatic transfer means has an electrostatic charge device which is mounted directly upstream of the transfer zone in the direction of transport of the transfer element. Alternatively, the electrostatic transfer means has an electrostatic charge device which is directly assigned to the transfer zone and is designed in such a way that it exerts an electrostatic force effect on the toner particles through the transfer element.

The heating means for heating the toner images on the transfer element has a heating device which is mounted upstream of the first transfer and fusing zone in the direction of transport of the transfer element and is arranged on the side of the toner images.

The heating means for heating the recording carrier has a preheating zone which is mounted upstream of the first transfer and fusing zone in the direction of transport of the recording carrier and has heating elements arranged therein.

A second transfer and fusing zone is arranged downstream of the first transfer and fusing zone at a distance in the direction of movement of the transfer element. A turning station is arranged as a continuation of the transport channel between the first and second transfer and fusing zones for single-sheet recording carriers. At least the first transfer and fusing zone has means which, when required, prevent the transfer of toner images onto the recording carrier.

The turning station has a feeding bar, arranged in a rear area of the turning station, for aligning the single sheets at their front edge. Lower transport elements, central transport elements and upper transport elements are arranged in a lower plane, a central plane and in an upper plane one on top of the other in a front area of the turning station and are motor-driven. The distance between the transport elements and the feeding bar is shorter than the length of the single sheets and the transport elements are operated in such a way that, in order to turn the single sheets, the single sheets are initially transported between the upper and central transport elements until they come to rest against the feeding bar. The single sheets then arch upwards as a result of continued operation of the transport elements. Their rear edge, guided by the central transport elements is flipped over into the region between the central transport elements and lower transport elements so that these transport elements grip the rear edge of the single sheets and transport them out of the turning station. Each of the transfer and fusing zones has a pair of rollers having a fused roller and a contact pressure roller around which the transfer element is wrapped and which can be swivelled in and away, the recording carrier being guided through between the pair of rollers. Alternatively, each of the transfer and fusing zones has a pair of rollers having a fused roller around which the transfer element is wrapped and having a further roller which can be swivelled in and away, the recording carrier being guided through between the fused and further rollers.

Each of the transfer and fusing zones has a suction roller or a roller with mechanical paper clamping device which grips the recording carrier and feeds it again to the respective transfer and fusing zone.

The transfer element has a temperature-resistant carrier fabric with an elastic cover layer. The transport channel is designed for the parallel transport of a plurality of single sheets arranged one next to the other.

A method of the present invention for printing on recording carriers in electrophotographic printing machines has the following features: producing a sequence of toner images of multi-layer structure, on an intermediate image-carrier by dry inking of the intermediate image-carrier with the aid of a two-component developer mixture; electrostatic transfer of the toner images onto a belt-type transfer element; heating of the toner images on the transfer element; and transfer of the heated, sticky toner images onto a recording carrier with simultaneous fusing of the toner images on the recording carrier by mechanical rolling of the transfer element on the recording carrier.

By means of the transfer of the print information from the photoconductor (intermediate image-carrier) to the belt-type transfer element by electrostatic influence it is possible to combine the advantages of the transfer belt technology with respect to fusing and design and operational reliability of the paper travel with the proven two-component development technology of known electrophotographic printers. The transfer of the print information from the photoconductor to the belt-type transfer element by means of electrostatic influence is of a very high quality. Since, in contrast to conventional recording carriers, for example paper, the transfer element has a very defined homogeneity, a marked increase in quality can be achieved particularly with respect to voids, lightenings of the print and print omissions as well as definition of contours.

The toner particles of the print image have enough time to fuse on on the path from the transfer zone of the transfer element to the transfer and fusing zone. At the same time, it is possible to preheat well the belt-type transfer element in a preheating zone before it enters the transfer and fusing zone. The result of this is that, in contrast with the roller fusing method, essentially no transfer of energy, but merely a mechanical rolling, takes place in the transfer and fusing zone. As a result, considerably lower absolute temperatures are necessary for this process. Since, in addition, the belt-type transfer element has a surface which is several times larger than that of conventional fusing rollers, a substantially improved service life, accompanied by a continuous quality over a long operating time with regard to the wear state, is provided.

Since the recording carrier is no longer brought into contact with the photoconductor, the problem of reliably freeing the recording carrier which adheres electrostatically to the photoconductor, preferably a photoconductor drum, no longer occurs. Furthermore, the wear situation of the photoconductor is substantially improved since the defined contact of the belt-type transfer element with the photoconductor is substantially gentler than the relatively undefined contact with various recording carriers with differing cut degree, with inclusions and with paper dust which may occur.

Thus, even when using photoconductor belts (OPCs) with critical wear properties, a considerably longer service life can be achieved.

With the printing machine or copying machine according to the invention, the recording carrier is both printed on and simultaneously fused in the transfer and fusing zones. As a result, it is possible to guide the recording carrier on both sides over the entire paper travel. In particular, the very critical feed-in into the transfer and fusing gap can, in contrast with conventional roller fusing methods, be configured in an optimum fashion by means of appropriate paper guides.

By virtue of the significantly lower process temperatures, pre-printed recording carriers can also be processed without difficulty even with conventional printing inks. By means of the arrangement of a second transfer and fusing zone, arranged downstream of the first transfer and fusing zone, and by means of the arrangement of a turning station between the transfer and fusing zones, which station is advantageously constructed as a stop turning station, it is possible to print on the front side and the rear side directly one after the other. As a result, a very simple paper travel can be formed without overtaking loops and waiting loops. The control structure and the mechanical procedures are clear and simple. This has a very advantageous effect on the operating behavior and the service-friendliness.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENT

Figure 1:
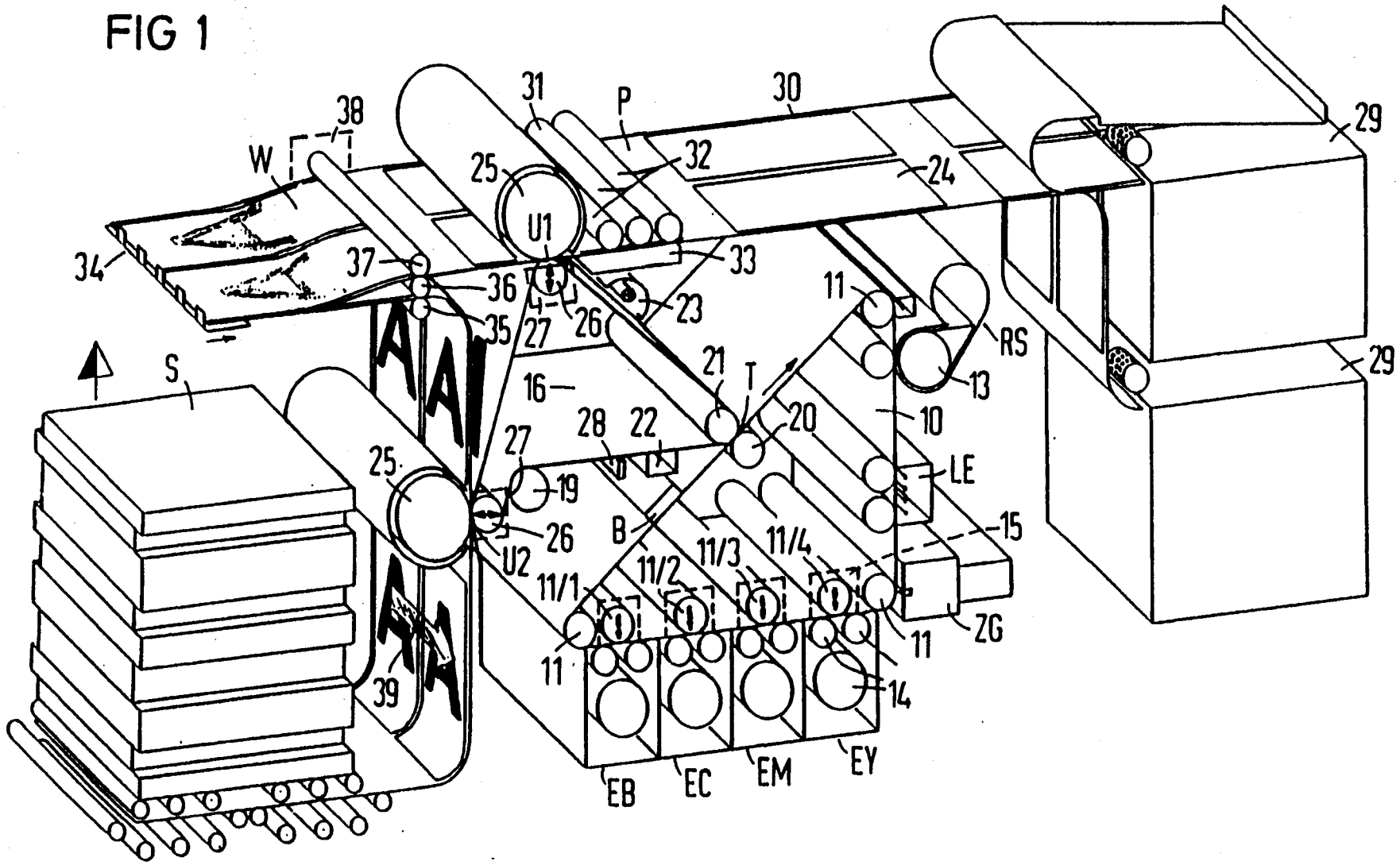
FIG. 1 shows a diagrammatic sectional view of an electrophotographic printing machine with belt-type transfer element with associated electrostatic device for transferring toner images from an intermediate image-carrier which is suitable both for simplex operation and for duplex operation.

An electrophotographic printing machine illustrated diagrammatically in FIG. 1 contains a belt-type intermediate image-carrier 10 in the form of a photoconductor (as used herein the phrase "intermediate image-carrier" is a photoconductor) for example an OPC belt which is guided over guide rollers 11 driven electromotively. Further, instead of the belt-type intermediate image-carrier, a photoconductor drum can also be provided. The various assemblies for the electrophotographic process are grouped around the intermediate image-carrier 10. The assemblies are essentially: a charge device LE in the form of a charge corotrone for charging the intermediate image-carrier; a character generator ZG with an LED comb for character-dependent exposure of the intermediate image-carrier 10; developing stations EY, EM, EC and EB for inking the charge image, which is discharged in a character-dependent fashion on the intermediate image-carrier 10 with the aid of colored toner. In this arrangement, the developing station EY contains yellow toner, the developing station EM contains magenta-colored toner, the developing station EC contains cyan-colored toner and the developing station EB contains black toner. In order to remove the residual toner after development and transfer, a cleaning station RS is provided with cleaning brush 13 which is integrated therein and has an associated suction device and a discharge device.

The developing stations EY, EM, EC and EB are of interchangeable design and can be drawn out of the machine and inserted into the machine, for example, via slide guides. They are of customary design and contain developer rollers 14 for inking the charge image and guide rollers 11/1 to 11/4 which can swivel in and away for swivelling the intermediate image-carrier 10 onto and away from the developer roller 14 by means of electromagnetic swivel devices 15. The swivel devices 15 here can be constructed, for example, as solenoid plunger magnets or, for example, as swivel magnets. They serve to couple the developing stations EY, EM, EC and EB, under the control of a machine control system, individually with the intermediate image-carrier 10 in order to permit multi-color and single-color printing. Arranged downstream of the developing station in the direction of movement of the intermediate image-carrier 10 there is an exposure station B which serves to loosen the developed toner image before transfer. Instead of an exposure station B it is also possible to arrange a discharge corotrone.

Figure 2:
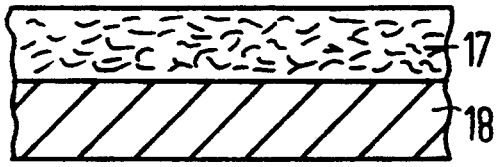
FIG. 2 shows a diagrammatic sectional view of the structure of a transfer element and FIG. 3 shows a diagrammatic sectional view of a transfer station with integrated charge station.

Furthermore, the printing device contains a transfer station T which serves to transfer the toner image onto a belt-type transfer element 16. The belt-type transfer element, according to the sectional view in FIG. 2, a temperature-resistant carrier fabric 17, for example made of glass fibers or similar materials, with elastic cover layer 18 which is arranged thereon and made of an elastomer. The belt-type transfer element 16 is guided here via guide elements so that the elastic cover layer faces the intermediate image-carrier 10. The belt-type transfer element 16 is driven electromotively. The transfer station T contains a lower guide roller 20 and an upper guide roller 21 between which the transfer element 16 and the belt-type intermediate image-carrier 10 is guided through in slight contact. The transfer of the toner image from the belt-type intermediate image-carrier 10 onto the belt-type transfer element 16 is effected by means of electrostatic transfer. As a result, it is possible to use as developer mixture for producing the toner image a two-component developer mixture composed of toner particles and ferromagnetic carrier particles. Developer mixtures of this kind produce during development toner images which are of multi-layer structure. However, the use of toner which is structured in a different fashion and also produces developed toner images of a multi-layer structure is also conceivable.

For electrostatic transfer, basically two methods are possible. In the exemplary embodiment illustrated in FIG. 1, an electrostatic charging of the surface of the belt of the belt-type transfer element 16 takes place directly upstream of the transfer station T with the transfer zone by means of a charging station 22 which can comprise, for example, a corotrone.

Figure 3:
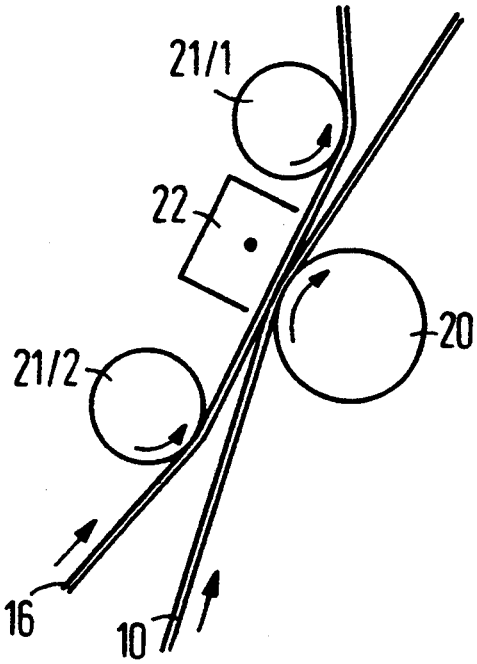

However, according to an exemplary embodiment in FIG. 3, it is also possible to arrange the corotrone in such a way that it exerts an electrostatic force effect on the toner particles through the belt-type transfer element 16 and transfers the toner particles onto the belt-type transfer element 16. For this purpose, the charge corotrone 22 can be arranged between two upper guide rollers 21/1, 21/2.

Because of the essentially electrostatic transfer effect, only very small forces and contact zones between the photoconductor 10 (belt-type intermediate image-carrier) and the belt-type transfer element 16 are necessary. As a result, excessive heating of the photoconductor is avoided. If, instead of the belt-type intermediate image-carrier 10, for example a photoconductor drum is used, it may be necessary to provide additional cooling measures by means of appropriate cooling devices.

The toner image which is transferred onto the belt-type transfer element 16 is heated, for example, with the aid of an infrared heating device 23 until the toner image is in a sticky state. Afterwards, it is transferred from the bottom onto a recording carrier 24 in a first transfer station U1.

The transfer station U1 serves both as transfer station and as fusing station. For this purpose, it contains two rollers, namely an upper roller 25 and a lower roller 26, between which the transfer element 16 and the recording carrier are guided through. The upper roller 25 has a turning device in the form of a suction roller, such as is disclosed, for example, in U.S. Pat. No. 4,447,176, or else a roller with mechanical gripper devices arranged thereon for gripping the single sheets (paper clamping device). Its function is explained later. The lower roller 26 is designed so as to be capable of being swivelled in and away with the aid of an electromagnetic device 27. However, it is also possible to design the lower roller 26 as a fused roller and the upper roller 25 as a roller which can be swivelled in and away. In the swivelled-away state of the lower roller 26, the belt-type transfer element 16 is guided in such a way that it does not come into contact with the recording carrier 24.

The driven belt-type transfer element 16 also passes through a second transfer station U2 which is constructed in accordance with the first transfer station U1. The second transfer station U2 has a cleaning roller 19 arranged downstream of it. The said cleaning roller 19 serves to remove the residual toner from the belt-type transfer element 16. The belt-type transfer element 16 is discharged via a subsequent discharging station 28 before it is placed again at a defined charge state by means of the charging station 22.

In order to feed the single sheets 24 from a supply area with supply stacks 29 arranged there to the transfer and fusing stations U1 and U2, a paper channel P is provided which, in a known manner, contains a multiplicity of paper transport rollers (not illustrated here for reasons of clarity). At the entry to the paper channel, there is an alignment zone 30 in which a selective alignment of the single sheets takes place via known alignment means, for example stops etc.. The first transfer and fusing station has mounted directly in front of it a paper preheating zone 31, it serves to preheat the single sheets before the application of the toner image onto the single sheets. For this purpose, the paper preheating zone 31 contains, for example, a multiplicity of contact pressure rollers 32 with an associated heating device 33 in the form of a preheating saddle, the single sheets being passed through between contact pressure rollers 32 and preheating saddle 33. The preheating saddle can have a metal carrier in which heating elements are arranged.

Between the first transfer and fusing station U1 and the second transfer and fusing station U2 there is a turning device W which is constructed in the form of a stop turning station. It contains in its rear area a feeding bar 34 for aligning the single sheets 24 at their front edge. In the entry area of the turning station W there are three transport elements which are arranged one on top of the other, are driven electromotively and, in the case illustrated, have paper rollers which cover the paper channel P. Instead of the paper rollers, it is also possible to use, for example, individual paper transport rollers. The paper transport rollers are divided into a lower paper transport roller 35, a central one 36 and an upper one 37. The upper and lower paper transport rollers rest elastically against the central paper transport roller 36, the central paper transport roller 36 being driven by means of an electric motor 38, specifically in an anti-clockwise direction. The distance between the paper transport rollers 35, 36 and 37 and the feeding bar 34 is shorter than the length of the single sheets 24. In order to turn the single sheets, the single sheets 24 are initially transported between the upper and central transport rollers 36, 37 until they come to rest against the feeding bar 34. As a result of continued operation of the transport rollers, the single sheets arch upwards and their rear edge is carried along by the central transport roller 37 in the direction of movement of the paper transport roller 37 and is thus flipped into the transport area between the lower paper transport roller 35 and the central one 36. Here, the rear edge of the single sheets is gripped by the lower paper transport roller 35 and the central one 36 and transported out of the turning station. This turning around and deflection of the single sheets 24 takes place continuously, particular stopping and controlling the paper transport rollers 35, 36 and 37 is not necessary.

After they leave the turning station, the individual sheets are deflected by deflection elements (not illustrated here) and fed to the transfer and fusing station U2. Arranged downstream of this second transfer and fusing station U2 is an association station 39, which is designed in a customary way and ensures necessary association if, as illustrated, recording carriers are guided in parallel and printed on in the paper channel ("two up print mode"). In this case, the single sheets must be associated before stacking in a stacking device S. The stacking device S serves as paper output station. It is designed in such a way that the single sheets of the stacking device S are fed from the bottom so that the stacking tray is built up offset from the bottom.

The function of the electrophotographic printing device with belt transfer is now described with reference to various possible modes of operation.

In the simplex printing mode of operation, the print image is initially produced in a single color in the conventional manner in the electrophotographic printing unit. Subsequently, this print image is transferred in the transfer station T from the photoconductor onto the heated belt-type transfer element 16, specifically in an electrostatic fashion as described. The print image transferred to the belt-type transfer element now fuses under the effect of the belt temperature or the additional infrared heating device 23 whilst it is transported in the direction of the first transfer and fusing station U1. The single sheets 24 to be printed on are guided, controlled by the control device of the printing device, in the paper channel P in such a way that, in the first print station U1, they meet in an exactly fitting fashion with the print image adhering to the transfer element 16. In the transfer zone, the print image is rolled onto the recording carrier 24 which has been previously preheated in the preheating zone 31. This transfer results in a simultaneous fusing of the print information. The recording carrier 24 is subsequently aligned again in the turning station W, turned and then transported via the second transfer and fusing station U2 in the direction of the stacking device S. In the case of simplex printing, the lower roller 26 is swivelled away with the aid of an electromagnetic device 27 so that the recording carriers 24 are guided freely through the second transfer and fusing station U2.

In the case of single-color duplex printing, the rear side of the recording carrier must be printed on in the region of the second transfer and fusing station U2. In this mode of operation, the toner image for the rear side is produced directly after the generation of the toner image for the front side on the intermediate image-carrier 10 and is also transferred onto the belt-type transfer element 16 directly after the transfer of the toner image of the front side. When the rear-side toner image passes through the first transfer and fusing station U1, the lower roller 26 is swivelled away with the aid of an electromotive swivel device 27 and thus the toner image freely passes through the transfer station. As a result, the print information is not damaged and meets the turned recording carrier 24 in the second transfer and fusing station U2. Transfer and fusing take place here with swivelled-in lower roller 26.

In single-side (simplex) printing, the information transfer takes place generally in the first transfer and fusing station U1. In this process, in contrast with front-side and rear-side printing (duplex), the single sheets can be fed through directly one after the other within a fused clock window. Of course, duplex printing requires in each case a gap in the feed clock.

For color printing, all the color separations are produced one after the other by activating the respective developing stations EY, EM, EC, EB electrophotographically and are transferred one after the other onto the belt-type transfer element 16. The single sheet to be printed on is fed again to the transfer and fusing zone at the respective first or second transfer and fusing station U1 or U2 with the aid of the upper roller 25 constructed as a suction roller or with a mechanical gripper until all the color separations are transferred. In this process, color printing is possible both in simplex and in duplex mode. The function cycle corresponds here to the described cycle for single-color simplex or duplex mode only that, in accordance with the manner of color printing, the single sheets are fed to the corresponding transfer zones via the suction rollers 25 until the corresponding color separations are all transferred onto the corresponding side of the single sheet 24.

With the described electrophotographic printing device, it is possible both to print on two smaller format single sheets arranged one next to the other and also to print on larger format single sheets. By appropriately activating the supply stack 29 with its drawing-off devices, a change of format during printing operation is also possible. It is also possible to change over between simplex and duplex mode or single-color simplex and single-color duplex mode, specifically as a function of the print information supplied by the printer control.

The invention is not limited to the particular details of the method and apparatus depicted and other modifications and applications are contemplated. Certain other changes may be made in the above described method and apparatus without departing from the true spirit and scope of the invention herein involved. It is intended, therefore, that the subject matter in the above depiction shall be interpreted as illustrative and not in a limiting sense.

What is claimed is:

1. An electrophotographic printing machine, comprising:

a photoconductor with at least one associated recording and developing station for producing toner images, said toner images having a multi-layer construction, on the photoconductor by dry inking of the photoconductor in the developing station with a two-component developer mixture;

a belt-type transfer element with associated transfer zone for transferring toner images from the photoconductor;

electrostatic transfer means assigned to the transfer zone;

a first combined transfer and fusing zone for transferring the tone images from the transfer element onto a recording carrier with simultaneous fusing of the toner images on the recording carrier by mechanical rolling of the transfer element on the recording carrier, said first combined transfer and fusing zone being spacially separated from said transfer zone for transferring toner images from the photoconductor;

a transport channel for transporting the recording carrier from a supply zone to the first transfer and fusing zone;

heating means for at least one of heating the toner images on the transfer element and heating the recording carrier upstream of the first transfer and fusing zone in a direction of transport of the recording carrier;

a second transfer and fusing zone arranged downstream of the first transfer and fusing zone at a distance in a direction of movement of the transfer element, and a turning station arranged as a continuation of the transport channel between the first and second transfer and fusing zones, for single-sheet recording carriers, at least the first transfer and fusing zone having means which, when required, prevent transfer of tone images onto the recording carrier.

2. The electrophotographic printing machine as claimed in claim 1, wherein the electrostatic transfer means has an electrostatic charge device which is mounted directly upstream of the transfer zone in a direction of transport of the transfer element.

3. The electrophotographic printing machine as claimed in claim 1, wherein the electrostatic transfer means has an electrostatic charge device which is directly assigned to the transfer zone and which exerts an electrostatic force effect on the tone through the transfer element.

4. The electrophotographic printing machine as claimed in claim 1, wherein the heating means for heating the toner images on the transfer element has a heating device which is mounted upstream of the first transfer and fusing zone in a direction of transport of the transfer element and is arranged on the side of the tone images.

5. The electrophotographic printing machine as claimed in claim 1, wherein the heating means for heating the recording carrier has a preheating zone which is mounted upstream of the first transfer and fusing zone in a direction of transport of the recording carrier and has heating elements arranged therein.

6. The electrophotographic printing machine as claimed in claim 1, wherein the turning station has a feeding bar, arranged in a rear area of the turning station, for aligning single sheets at their front edge, and has lower transport elements, central transport elements and upper transport elements which are arranged in a lower plane, a central plane and in an upper plane, respectively, one on top of the other in a front area of the turning station and are motor-driven, a distance between the transport elements and the feeding bar being shorter than a length of the single sheets and the transport elements being operated in such a way that, in order to turn the single sheets, the single sheets are initially transported between the upper and central transport elements until the single sheets come to rest against the feeding bar, that, the single sheets then arch upwards as a result of continued operation of the upper and central transport elements and their rear edge, guided by the central transport elements is flipped over into a region between the central transport elements and lower transport elements so that the lower and central transport elements grip the rear edge of the single sheets and transport the single sheets out of the turning station.

7. The electrophotographic printing machine as claimed in claim 1, wherein each of the transfer and fusing zones has a pair of rollers having a fixed upper roller and a lower contact pressure roller around which the transfer element is wrapped and which can be swivelled in and away, the recording carrier being guided through between said fixed upper roller and said lower contact pressure roller.

8. The electrophotographic printing machine as claimed in claim 1, wherein each of the transfer and fusing zones has a pair of rollers having a fixed lower contact pressure roller around which the transfer element is wrapped and having an upper roller which is swivellable in and away, the recording carrier being guided through between said upper roller and said fixed lower contact pressure roller.

9. The electrophotographic printing machine as claimed in claim 1, wherein the transfer element has a temperature-resistant carrier fabric with an elastic cover layer.

10. The electrophotographic printing machine as claimed in claim 1, wherein the transport channel is designed for parallel transport of a plurality of single sheets arranged one next to the other.

11. The electrophotographic printing machine as claimed in claim 1, wherein each of the first and second transfer and fusing zones has one of a suction roller and a roller with mechanical paper clamping device which grip the recording carrier and feed it again to the respective transfer and fusing zone.

12. An electrophotographic printing machine, comprising:

a photoconductor with at least one associated recording and developing station for producing toner images, said toner images having a multi-layer construction, on the photoconductor by dry inking of the photoconductor in the developing station with a two-component developer mixture;

a belt-type transfer element with associated transfer zone for transferring toner images from the photoconductor;

electrostatic transfer means assigned to the transfer zone;

a first combined transfer and fusing zone for transferring the tone images from the transfer element onto a recording carrier with simultaneous fusing of the toner images on the recording carrier by mechanical rolling of the transfer element on the recording carrier, said first combined transfer and fusing zone being spacially separated from said transfer zone for transferring toner images from the photoconductor;

a transport channel for transporting the recording carrier from a supply zone to the first transfer and fusing zone;

heating means for at least one of heating the toner images on the transfer element and heating the recording carrier upstream of the first transfer and fusing zone in a direction of transport of the recording carrier;

the transfer and fusing zone having one of a suction roller and a roller with mechanical paper clamping device which grip the recording carrier and feed it again to the transfer and fusing zone.

13. An electrophotographic printing machine, comprising:

a photoconductor with associated recording and developing station for producing toner images, said toner images having a multi-layer construction, on the photoconductor by dry inking of the photoconductor in the developing station with a two-component developer mixture;

a belt-type transfer element with associated transfer zone for transferring toner images from the photoconductor;

electrostatic transfer means assigned to the transfer zone;

a first combined transfer and fusing zone for transferring the tone images from the transfer element onto a recording carrier with simultaneous fusing of the toner images on the recording carrier by mechanical rolling of the transfer element on the recording carrier;

a transport channel for transporting the recording carrier from a supply zone to the first transfer and fusing zone; and heating means for at least one of heating the toner images on the transfer element and heating the recording carrier;

a second transfer and fusing zone arranged downstream of the first transfer and fusing zone at a distance in a direction of movement of the transfer element; and a turning station arranged as a continuation of the transport channel between the first and second transfer and fusing zones, for single-sheet recording carriers, at least the first transfer and fusing zone having means which, when required, prevent transfer of toner images onto the recording carrier.

14. The electrophotographic printing machine as claimed in claim 13, wherein the turning station has a feeding bar, arranged in a rear area of the turning station, for aligning single sheets at their front edge, and has lower transport elements, central transport elements and upper transport elements which are arranged in a lower plane, a central plane and in an upper plane, respectively, one on top of the other in a front area of the turning station and are motor-driven, a distance between the transport elements and the feeding bar being shorter than a length of the single sheets and the transport elements being operated in such a way that, in order to turn the single sheets, the single sheets are initially transported between the upper and central transport elements until the single sheets come to rest against the feeding bar, that, the single sheets then arch upwards as a result of continued operation of the upper and central transport elements and their rear edge, guided by the central transport elements is flipped over into a region between the central transport elements and lower transport elements so that the lower and central transport elements grip the rear edge of the single sheets and transport the single sheets out of the turning station.

15. The electrophotographic printing machine as claimed in claim 13, wherein each of the transfer and fusing zones has a pair of rollers having a fixed upper roller and a lower contact pressure roller around which the transfer element is wrapped and which can be swivelled in and away, the recording carrier being guided through between said fixed upper roller and said lower contact pressure roller.

16. The electrophotographic printing machine as claimed in claim 13, wherein each of the transfer and fusing zones has a pair of rollers having a fixed lower contact pressure roller around which the transfer element is wrapped and having an upper roller which is swivellable in and away, the recording carrier being guided through between said upper roller and said fixed lower contact pressure roller.

* * * * *